US006970085B2

(12) United States Patent
Okabe et al.

(10) Patent No.: US 6,970,085 B2
(45) Date of Patent: Nov. 29, 2005

(54) DOOR SENSOR AND DOOR EQUIPPED WITH SUCH DOOR SENSOR

(75) Inventors: Junichiro Okabe, Ohtsu (JP); Toshiyasu Matsuyama, Ohtsu (JP)

(73) Assignee: OPTEX Co., Ltd., Shiga (JP)

( * ) Notice: Subject to any disclaimer, the term of this patent is extended or adjusted under 35 U.S.C. 154(b) by 81 days.

(21) Appl. No.: 10/614,294

(22) Filed: Jul. 8, 2003

(65) Prior Publication Data

US 2004/0140782 A1 Jul. 22, 2004

(30) Foreign Application Priority Data

Jul. 9, 2002 (JP) ..... 2002-199802

(51) Int. Cl.[7] ..... G08B 13/08

(52) U.S. Cl. ..... 340/545.6; 340/545.1; 340/545.3; 340/547; 340/480; 340/551

(58) Field of Search ..... 340/545.1, 545.3, 340/545.6, 545.9, 547, 551, 467, 480; 318/480, 318/450, 460, 467, 445; 250/221, 209, 338, 250/341.1, 211

(56) References Cited

U.S. PATENT DOCUMENTS 5,963,000 A * 10/1999 Tsutsumi et al. ..... 318/480
6,292,100 B1 * 9/2001 Dowling ..... 340/545.6
6,304,178 B1 * 10/2001 Hayashida ..... 340/545.1
2004/0113778 A1 * 6/2004 Script et al.

FOREIGN PATENT DOCUMENTS

JP 9-209652 8/1997

OTHER PUBLICATIONS

Provisional U.S. Appl. No. 60/018,829, Filed on May 30, 1996, Script et al.*

* cited by examiner

*Primary Examiner*—Hung Nguyen
(74) *Attorney, Agent, or Firm*—Wenderoth, Lind & Ponack, L.L.P.

(57) ABSTRACT

Door sensor(s) may be attached to a door body or bodies of automatic swing doors. The door sensor(s) may be equipped with door position detectors including geomagnetic sensor(s), the sensor(s) being itself or themselves capable of detecting position(s) occupied by the door body or bodies during opening and/or closing thereof. During opening and/or closing of the door body or bodies, determination may be made as to whether detected object(s) are object(s) intended for detection; and in the event that object(s) are object(s) intended for detection, opening and/or closing of the door body or bodies may be stopped, slowed, and/or reversed in correspondence to detected position(s) occupied by the door body or bodies during opening and/or closing thereof.

22 Claims, 11 Drawing Sheets

DOOR SENSOR AND DOOR EQUIPPED WITH SUCH DOOR SENSOR

BACKGROUND OF INVENTION

The present invention relates to a door sensor with which a swing door or the like may be equipped and to a door equipped with such a door sensor. In particular, the present invention pertains to a strategy for achieving simplified door sensor constitution.

A typical automatic swing door will conventionally be positioned in a closed position such that the door body closes off the door opening under circumstances where no one is approaching the door. Furthermore, in the event that someone approaches the door from one side, this side representing the near side thereof, the door body can be made to swing toward the side opposite the near side, this opposite side representing the far side thereof, clearing the door opening and allowing passage therethrough.

In order to be able to cause such opening operations to occur, this type of door might be provided with a near-side sensor on the near-side face of the header constituting the upper frame of the door opening. That is, approach of persons from the near side is detected by the near-side sensor, a door drive mechanism is driven in accompaniment to such detection, and the door body is made to swing toward the far side.

Furthermore, in the event that a person is present in the region of the swinging door when the door body is swinging, it will be necessary to stop the swinging and/or decrease the speed of swinging so as to prevent the door body from coming in contact with the person. For this reason, a far-side sensor might be provided at the far-side face of the header in order to permit detection of presence and/or absence of persons at the far side of the door body.

However, in the case of the aforementioned conventional automatic swing door, the door body will pass through the detectable zone of the far-side sensor during swinging of the door body.

For this reason, the far-side sensor being incapable of carrying out detection with respect to those regions of the detectable zone which are in the lee of the door body as this door body passes therethrough, it has sometimes been the case where a person was present in the region of the swinging door but could not be detected despite such fact.

One example which may be cited as means for remedying such a problematic situation is attachment of a far-side sensor to the door body. If this is done, because the far-side sensor moves in accompaniment to the swinging of the door body, the door body will not pass through the detectable zone of the far-side sensor.

However, with such a constitution, the detectable zone of the far-side sensor will change in accompaniment to the swinging of the door body. For this reason, detection will extend to objects (e.g., wall surfaces, railings, etc.) which exist at locations outside of the region of the swinging door body (i.e., at locations which would not come in contact with the door body even if it were to swing therethrough), these being structures or the like at the periphery of the door.

Accordingly, when employing a constitution in which a far-side sensor is attached to the door body in this fashion, it will be necessary to be able to identify the position occupied by the swinging door body and to be able to determine whether an object detected by the far-side sensor is an object intended for detection based on the position of the swinging door body.

However, there has not to date been a proposal in connection with the carrying out of such determination as would permit adequate reliability to be attained with a simple constitution.

For example, a constitution might be contemplated in which the door drive mechanism (drive motor or the like) is provided with an ability to identify the angular displacement position of the door and an output signal therefrom is received by the far-side sensor, determination as to whether an object detected by the far-side sensor is a person or other such target object intended for detection being made in correspondence to the angular displacement position of the door body.

However, with such a constitution, not only would there be a need to add a new capability, i.e., ability to identify angular displacement position, to the door drive mechanism, but there would also be a separate need for wiring to permit the output signal from the door drive mechanism to be sent to the far-side sensor, which would tend to make the constitution more complex and complicate installation procedures. Furthermore, because door drive mechanisms of automatic swing doors which have already been installed will perforce not have been provided with ability to identify the angular displacement position, employment of this constitution therein will, practically speaking, be impossible. That is, such a constitution is not of the type that can be achieved by retrofitting a preexisting automatic swing door.

In order to increase the practicality of the aforementioned constitutions wherein far-side sensors are attached to door bodies, the inventor(s) of the present invention therefore arrived at the present invention upon recognizing that there was a need to be able to determine whether a detected object is a person or other such target object intended for detection in correspondence to the angular displacement position of the door body, but to be able to do this without changing the conventional constitution of the door drive mechanism (i.e., to be able to do this with a door drive mechanism which has not been provided with ability to identify angular displacement position).

Furthermore, the aforementioned problematic situation is not limited to automatic swing doors but may also arise in like fashion with automatic revolving doors, automatic folding doors, upward-pivoting gate doors, and the like. Moreover, with such doors, the aforementioned problematic situation may arise in like fashion when applied to a door sensor functioning as a safety sensor during closing (e.g., in the event that the aforementioned near-side sensor is made to function as a safety sensor, etc.).

The present invention was conceived in light of such issues, it being an object thereof to provide a door sensor and a door equipped with such door sensor(s) which do not tend to produce a more complex constitution and/or more complicated installation procedures in the context of a constitution wherein far-side sensor(s) or other such sensor(s) which might be referred to as safety sensor(s) is or are attached to door body or bodies.

SUMMARY OF INVENTION

Summary of Invention

In order to achieve the foregoing and/or other objects, embodiment(s) of the present invention may be such that sensor(s) attached to a door body or bodies is or are itself or themselves provided with ability to detect position(s) occupied by the door body or bodies during opening and/or closing thereof, position(s) occupied by the door body or bodies during opening and/or closing thereof being identified without the need to receive door position information from external equipment, and movement of the door body or bodies may be controlled in correspondence thereto.

Solution Means

More specifically, door position detecting means, object detecting means, and object determining means may be provided. Door position detecting means may be attached to the door body or bodies that can be opened and/or closed and may be capable of detecting position(s) occupied by the door body or bodies during opening and/or closing thereof. Object detecting means may be attached to the door body or bodies and may detect presence and/or absence of object(s) in detectable zone(s). Object determining means may receive output(s) from door position detecting means and object detecting means, and may determine, in correspondence to position(s) occupied by the door body or bodies during opening and/or closing thereof, whether object(s) detected by the object detecting means are object(s) intended for detection.

As a result of such specific features, it will be possible for door sensor(s) to itself or themselves detect position(s) occupied by the door body or bodies during opening and/or closing thereof, position(s) occupied by the door body or bodies during opening and/or closing thereof being identified without the need to receive door position information from external equipment (e.g., door drive mechanism(s)), and it will be possible for movement of the door body or bodies to be controlled in correspondence thereto. This being the case, there will no longer be a need for addition of a new ability to identify angular displacement position to door drive mechanism(s) or other such external equipment, and moreover, there will no longer be a need for wiring installation procedures to permit output signal(s) from such external equipment to be sent to door sensor(s). This being the case, it is possible to avoid making the constitution more complex and/or making installation procedures more complicated. Furthermore, with respect to automatic swing doors and other such doors which have already been installed, by simply attaching the present door sensor(s) to the door body or bodies it will be possible to control movement of the door body or bodies in correspondence to position(s) occupied by the door body or bodies during opening and/or closing thereof, and it will be possible, by retrofitting a preexisting door, to construct a door which will permit attainment of the foregoing effect.

As the foregoing door position detecting means, it is possible, in specific terms, to employ door position detecting means which is or are attached to the door body or bodies made capable of being opened and/or closed as a result of rotational motion and which is or are constituted so as to be capable of detecting angular displacement position(s) of the door body or bodies. More specifically, door position detecting means may be made up of sensor(s) employing geomagnetism to detect angular displacement position(s) of the door body or bodies and/or sensor(s) employing gyroscope(s) to detect angular displacement position(s) of the door body or bodies. Such constitution might be suitable, for example, where the present invention is applied to automatic swing door(s), automatic revolving door(s), or the like. Furthermore, where the present solution means is applied to sliding door(s), sensor(s) capable of detecting rotation of cam(s) and/or roller(s) of slide mechanism(s) could be attached thereto.

The following may be presented as examples of constitutions permitting control of movement of the door body or bodies in accompaniment to identification of position(s) occupied by the door body or bodies during opening and/or closing thereof. To wit, door sensor(s) may be attached to surface(s) facing toward direction(s) toward which the door body or bodies move during opening thereof. Furthermore, door controller(s) may be provided that stop, slow, and/or reverse the process of opening the door body or bodies in the event that object(s) detected by object detecting means are object(s) intended for detection.

Furthermore, door sensor(s) may be attached to surface(s) facing toward direction(s) toward which the door body or bodies move during closing thereof. In such a case, door controller(s) may be provided that stop, slow, and/or reverse the process of closing the door body or bodies in the event that object(s) detected by object detecting means are object(s) intended for detection.

In the case of the former constitution (i.e., a constitution in which door sensor(s) are attached to surface(s) facing toward direction(s) toward which the door body or bodies move during opening thereof) it will be possible to prevent the door body or bodies from coming in contact with person(s) or the like when the door body or bodies are being opened; and in the case of the latter constitution (i.e., a constitution in which door sensor(s) are attached to surface(s) facing toward direction(s) toward which the door body or bodies move during closing thereof) it will be possible to prevent the door body or bodies from coming in contact with person(s) or the like when the door body or bodies are being closed. Particularly in the latter case it will be possible for activation sensor(s) to also serve as door sensor(s).

In a specific example of the overall constitution of a door sensor, sensor package(s) might be provided, and door position detecting means, object detecting means, and object determining means might be housed within such sensor package(s). This being the case, procedures for attaching the present door sensor(s) to door(s) might be such that sensor package(s) could be attached to the door surface(s) by means of adhesive or the like, facilitating attachment procedures.

Furthermore, the foregoing constitution(s) may be equipped with fixed object detecting means which is or are attached to fixed object(s) installed at arbitrary location(s) and which detects or detect presence and/or absence of object(s) within detectable zone(s), the detectable zone(s) being previously established fixed location(s).

As a result of such specific features, it will be possible to cause even detectable zone(s) which might otherwise change and come to be outside of region(s) intended for detection as a result of movement of the door body or bodies to continue to be that or those intended for detection by virtue of fixed object detecting means, making it possible to more definitively carry out detection of objects within desired range(s).

Furthermore, position information output(s) from one door position detecting means may be used in shared fashion with a plurality of object detection outputs from a plurality of object detecting means.

As a result of such specific features, it will be possible to decrease the number of door position detecting means as compared with the situation where one object detecting means is provided with one door position detecting means. This is therefore preferred in that it permits reduction in manufacturing cost and a simplified constitution.

Furthermore, whereas object detecting means may be constituted so as to permit switching between or among detectable zones, zone switching means may be provided which receives or receive output(s) from door position detecting means and which switch between or among detectable zones of object detecting means in correspondence to position(s) occupied by the door body or bodies during opening and/or closing thereof.

As a result of such specific features, it will be possible to switch detectable zones of object detecting means, avoiding object(s) not intended for detection, in correspondence to position(s) occupied by the door body or bodies during opening and/or closing thereof. Furthermore, expansion of the ways in which door sensor(s) may be used will be permitted, inasmuch as door sensor(s) might, in correspondence to position(s) occupied by the door body or bodies during opening and/or closing thereof, temporarily be made to function as activation sensor(s), or might alternatively or additionally be made to function as safety sensor(s).

A door which is such that any one of the door sensors of the foregoing respective solution means is attached to the door body or bodies, the door body or bodies engaging in opening and/or closing operations in linked fashion with object detecting operations of the door sensor(s), is also within the purview of the technical idea of the present invention.

DESCRIPTION OF PREFERRED EMBODIMENTS

Below, embodiments of the present invention are described with reference to the drawings.

Embodiment 1

A first embodiment will first be described. The present embodiment concerns a situation in which the present invention has been applied to an automatic swing door.

Figure 1:
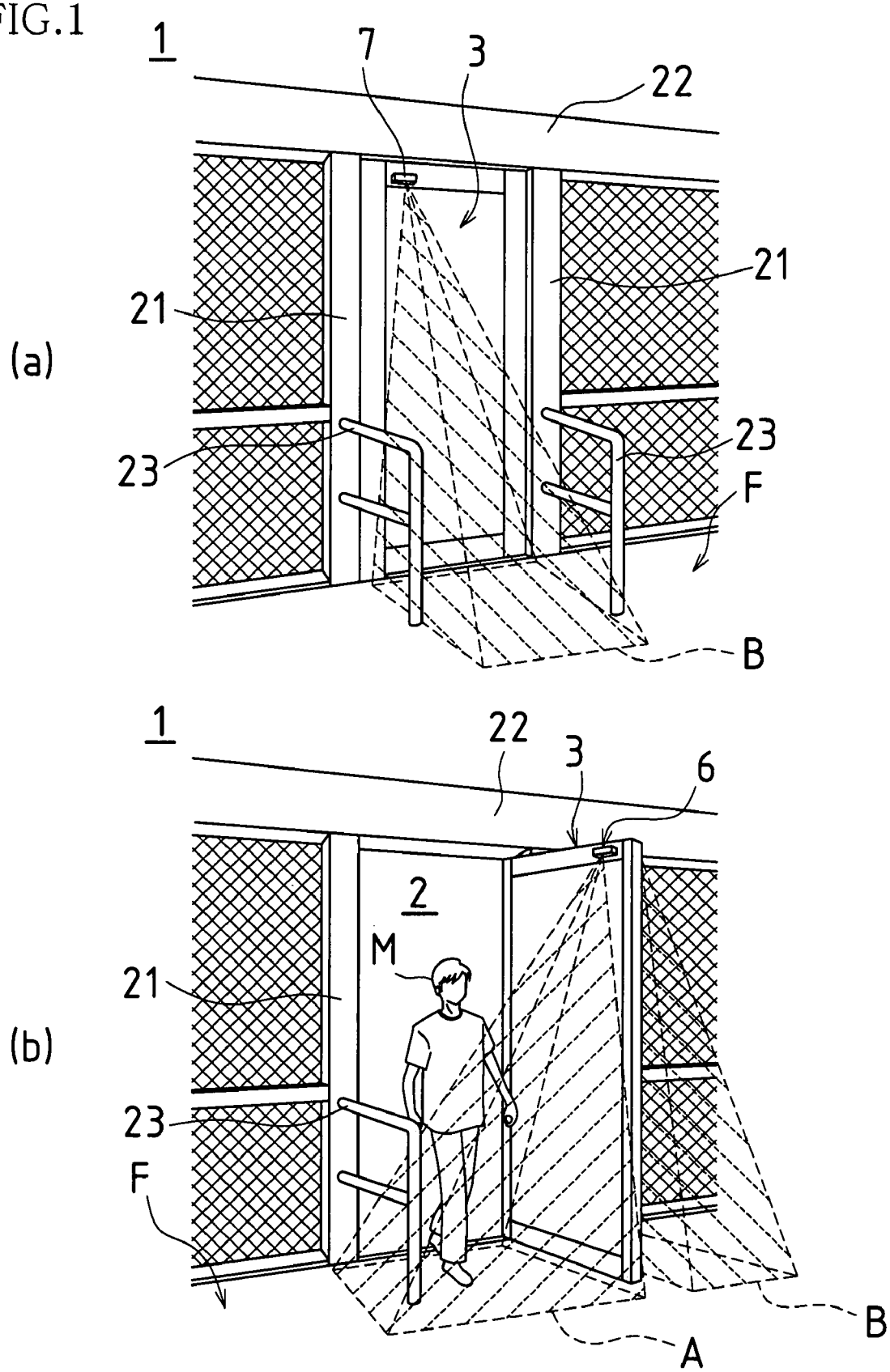
FIG. 1(*a*) is a drawing showing a closed door and FIG. 1(*b*) is a drawing showing an open door, these being oblique views of an automatic swing door associated with a first embodiment.
Figure 2:
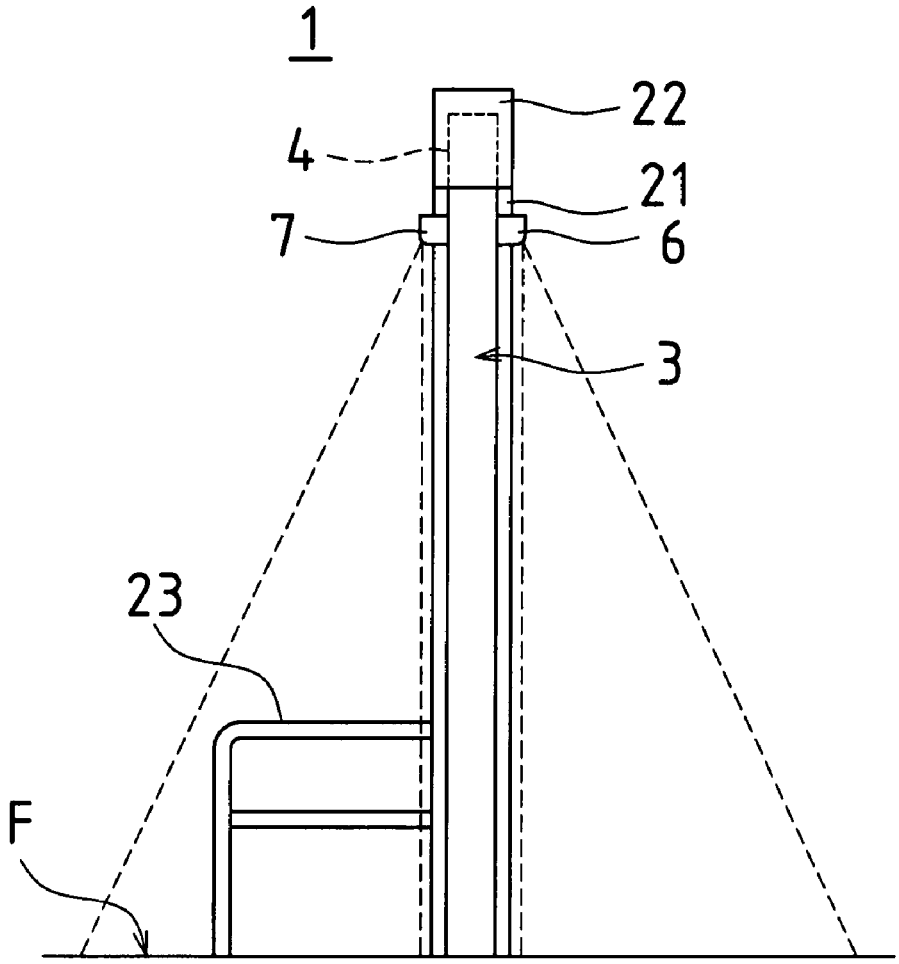
FIG. 2 is a side view of an automatic swing door when in its closed state.
Figure 3:
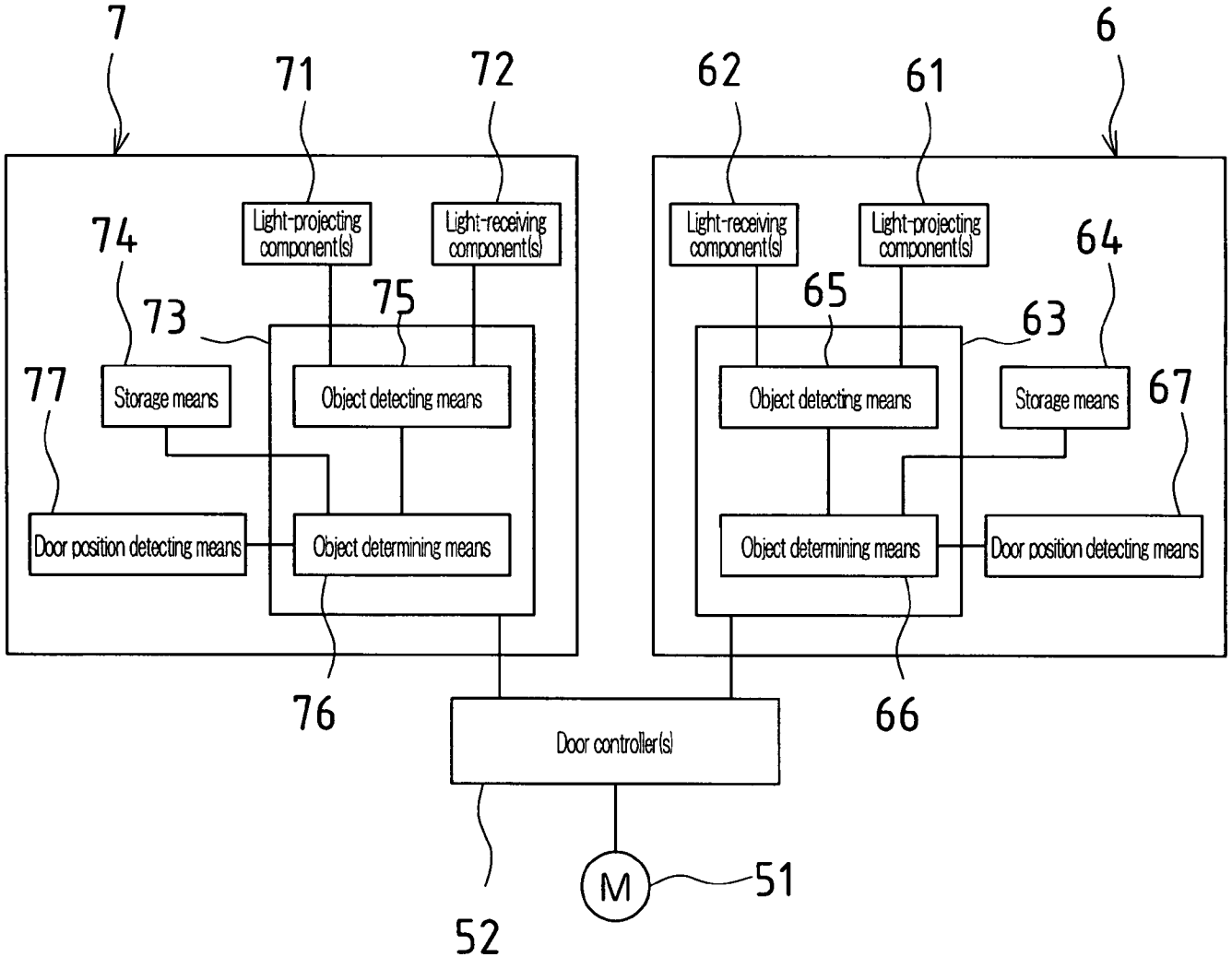
FIG. 3 is a block diagram showing a control system for an automatic swing door.

FIG. 1 contains oblique views of an automatic swing door 1 associated with the present embodiment, (a) showing the door in its closed state and (b) showing the door in its open state. FIG. 2 is a side view of automatic swing door 1 when in its closed state. FIG. 3 is a block diagram showing a control system for this automatic swing door 1.

-Description of Overall Constitution of Automatic Swing Door 1-

As shown in FIGS. 1 and 2, at this automatic swing door 1, door opening 2 is formed from pair of side jambs 21, 21, which are arranged perpendicularly and with prescribed distance therebetween over floor F, and header 22, which straddles the top portions of these two side jambs 21, 21. In addition, attached to this door opening 2 is door body 3 of shape and size as will permit closure thereof. The position of this door body 3 when it closes off door opening 2 is referred to as its closed position (see FIG. 1(*a*)).

This door body 3 possesses pivot(s), not shown, extending vertically in the vicinity of one of the side jambs 21 (the one on the right side in FIG. 1), door body 3 being capable of swinging about such pivot(s). Such swinging occurs to a position such as will allow person(s) M to pass through door opening 2, the position at which swinging stops being referred to as the open position (see FIG. 1(*b*))

Note that in the description that follows, the side of the vantage point from which FIG. 1 is viewed and the left side in FIG. 2 will be referred to as the far side, and the side opposite the vantage point from which FIG. 1 is viewed and the right side in FIG. 2 will be referred to as the near side. Furthermore, the region through which door body 3 passes during swinging thereof will be referred to as the swing region.

In order to cause swinging of the door body 3, drive apparatus 4 is provided within header 22. As shown in FIG. 3, this drive apparatus 4 might for example possess motor 51 and door controller 52 for controlling this motor 51.

Moreover, railings 23, 23 are provided to the far side of side jambs 21, 21.

-Description of Control System for Automatic Swing Door 1-

Attached to either face of the door body 3 of automatic swing door 1 associated with the present embodiment is a door sensor 6, 7 constituted such that the respective means to be described below are housed as package(s) therewithin. Each door sensor 6, 7 is attached to the door body 3 at a location which is near the top thereof and which is near the side edge at the side opposite the side supported by the foregoing pivot(s).

More specifically, sensor 6 attached to the near-side face of the door body 3 is a near-side sensor 6 which functions as an activation sensor for, in the event that person(s) approach from the near side, detecting such fact and causing door body 3 to swing.

On the other hand, sensor 7 attached to the far-side face of door body 3 is a far-side sensor 7 which functions as a safety sensor for, in the event that person(s) are present in the swing region when door body 3 is swinging, detecting such fact and stopping swinging, reducing swing speed, and/or reversing direction of swinging so as to prevent door body 3 from coming into contact with person(s).

As shown in FIG. 3, respective sensor 6, 7 possess light-projecting components 61, 71 and light-receiving components 62, 72. Light-projecting components 61, 71 might for example be equipped with a plurality of infrared light emitting diodes which project light toward floor F pursuant to control by CPUs 63, 73. Broken line(s) A at FIG. 1 indicate the zone into which light is projected by light-projecting component 61 of near-side sensor 6, and broken line(s) B at FIG. 1 indicate the zone into which light is projected by light-projecting component 71 of far-side sensor 7. After being reflected, this light is received by light-receiving components 62, 72. Received light signal(s) are supplied to CPUs 63, 73, object detecting means 65, 75 provided at CPUs 63, 73 determining whether the value(s) of the received light signal(s) are such that the value(s) of the received light signal(s) fall within PASS region(s) established based on respectively previously defined reference value(s) and tolerance(s), and if the value(s) of the received light signal(s) do not fall within PASS region(s) then determination is made that object(s) have been detected, in which case the object detecting means 65, 75 generate detected object signal(s).

Moreover, the foregoing reference value(s) may be reset at each door position; i.e., at each of a number of position(s) separated by prescribed angle(s) as the door body 3 is rotated from its closed position to its open position. These reference values are stored in storage means 64, 74 comprising EEPROM or the like. "Teaching" operations are performed responsive to actuation of switch(es), e.g., "teaching" switches, these reference values being established as a result of such operations. That is, with no person or the like present within detectable zone(s), door body 3 might be made to rotate from its closed position to its open position in prescribed angular increments, any change in amount(s) of light received by light-receiving components 62, 72 at such time being identified and reference value(s) being set based thereon, with reference value(s) at respective rotary positions being stored in storage means 64, 74 so as to prevent misidentification of walls or other such objects not intended for detection and/or so as to mitigate any adverse effect due to changes in the way light is reflected from the floor.

Furthermore, respective door sensors 6, 7 are equipped with door position detecting means 67, 77. These door position detecting means 67, 77 are constructed so as to be capable of detecting position(s) occupied by door body 3 during opening and/or closing thereof; i.e., angular displacement position(s) of the door body 3. More specifically, these door position detecting means 67, 77 are made up of sensors (hereinafter "geomagnetic sensors") which employ geomagnetism to detect the angular displacement position of the door body 3. That is, in that they move together with the opening and/or closing (i.e. rotation) of the door body 3, they are able to identify changes in geomagnetism and to detect the angular displacement position of the door body 3 based thereon.

Note that while there will not in particular be a problem if the environment in which automatic swing door 1 is installed is such that a magnetic field sufficient to permit identification of changes in geomagnetism by door position detecting means 67, 77 is present; but where an adequate magnetic field is not present, a magnet or other such magnetic field generating means should be embedded in the ground or otherwise provided at the location at which automatic swing door 1 is installed or in the surrounding area so as to ensure that a suitable magnetic field is present.

Object determining means 66, 76 are constructed such that they receive output from the foregoing door position detecting means 67, 77 and object detecting means 65, 75, as well as information stored at storage means 64, 74. Moreover, these object determining means 66, 76 compare respective signals and determine, in correspondence to the angular displacement position of the door body 3, whether detected object(s) are person(s) or other such object(s) intended for detection, or whether detected object(s) are wall(s) and/or railing(s) 23 identified during the foregoing "teaching" or other such object(s) not intended for detection.

Moreover, at near-side sensor 6, if object(s) are determined to be object(s) intended for detection, then detected object signal(s) are supplied to the door controller 52. As a result, swinging of the door body 3 commences.

On the other hand, at far-side sensor 7, detected object signal(s) are supplied to door controller 52 if—and only if—object(s) detected while door body 3 is swinging in a direction such as would tend to cause it to open are determined to be object(s) intended for detection. As a result, swinging of the door body 3 might be stopped, swing speed might be reduced, and/or swing direction might be reversed (i.e., door body 3 might be made to swing in a direction such as would tend to cause it to close).

Furthermore, at the foregoing near-side sensor 6, detected object signal(s) are also be supplied to the door controller 52 if object(s) detected while door body 3 is swinging in a direction such as would tend to cause it to close are determined to be object(s) intended for detection. As a result, swinging of the door body 3 in a direction such as would tend to cause it to close might be stopped, swing speed might be reduced, and/or swing direction might be reversed (i.e., door body 3 might be made to swing in a direction such as would tend to cause it to open).

Because the control system of automatic swing door 1 is constituted as described above, opening and/or closing of automatic swing door 1 is carried out as described below.

First, when door body 3 is in its closed state as shown in FIG. 1(*a*), if a person approaches from the near side, then object detecting means 65 of near-side sensor 6 generates detected object signal(s). In accompaniment thereto, control exercised by door controller 52 causes activation of motor 51, initiating swinging of the door body 3 in a direction such as would tend to cause it to open.

At such time, far-side sensor 7 detects any object(s) which may be present in far-side detectable zone(s). And if person(s) or other such object(s) are not present in detectable zone(s), then swinging of the door body 3 continues unchecked until the open position is reached. At such time, whereas railing(s) 23 will come to fall within detectable zone(s) of far-side sensor 7 in accompaniment to swinging of the door body 3, any detection signal(s) due to such railing(s) 23 will be canceled as a result of having performed the "teaching" operations already described above.

And if object(s) detected while this door body 3 is swinging in a direction such as would tend to cause it to open are person(s) or other such object(s) intended for detection, then detected object signal(s) are supplied from object determining means 76 to door controller 52. As a result, swinging of the door body 3 might be stopped, swing speed might be reduced, and/or swing direction might be reversed (i.e., door body 3 might be made to swing in a direction such as would tend to cause it to close), preventing collision of the door body 3 with person(s) or other such object(s) present in the far-side region. And after person(s) or other such object(s) present in this far-side region move outside of detectable zone(s), door body 3 is allowed to swing until it reaches its open position.

After door body 3 is maintained in its open state for a prescribed time, swinging of door body 3 in a direction such as would tend to cause it to close commences. At such time, near-side sensor 6 detects any object(s) which may be present in near-side detectable zone(s). And if person(s) or other such object(s) are not present in detectable zone(s), then swinging of the door body 3 continues unchecked until the closed position is reached. At such time, whereas railing(s) 23 will come to fall within detectable zone(s) of near-side sensor 6 in accompaniment to swinging of the door body 3; here as well, any detection signal(s) due to such railing(s) 23 will be canceled as a result of having performed the "teaching" operations already described above.

And if object(s) detected by near-side sensor 6 while this door body 3 is swinging in a direction such as would tend to cause it to close are person(s) or other such object(s) intended for detection, then detected object signal(s) are supplied from object determining means 66 to door controller 52. As a result, swinging of the door body 3 might be stopped, swing speed might be reduced, and/or swing direction might be reversed (i.e., door body 3 might be made to swing in a direction such as would tend to cause it to open), preventing collision of the door body 3 with person(s) or other such object(s) present in the far-side region. And after person(s) or other such object(s) present in this near-side region move outside of detectable zone(s), door body 3 is allowed to swing until it reaches its closed position.

As described above, in the present embodiment it is possible for respective sensors 6, 7 to themselves detect position(s) occupied by door body 3 during opening and/or closing thereof, position(s) occupied by door body 3 during opening and/or closing thereof being identified without the need to receive information from drive apparatus 4, and it is possible for opening and/or closing of the door body 3 to be controlled in correspondence thereto. This being the case, there will no longer be a need for addition of a new ability to identify angular displacement position to drive apparatus 4, and moreover, there will no longer be a need for wiring installation procedures to permit output signal(s) from drive apparatus 4 to be sent to door sensors 6, 7. It is consequently possible to avoid making the constitution more complex and/or making installation procedures more complicated. Furthermore, with respect to automatic swing doors 1 which have already been installed, by simply attaching the present door sensors 6, 7 to the door body 3 it is possible to control movement of the door body 3 in correspondence to position(s) occupied by door body 3 during opening and/or closing thereof, and it is possible to easily retrofit a preexisting door 1.

Variations on Embodiment 1

Whereas the foregoing first embodiment was described in terms of an example in which the present invention was applied to both a near-side sensor 6 and a far-side sensor 7, it is also possible to apply the present invention to only far-side sensor 7. In such a case, as near-side sensor 6 will only function as activation sensor, it is preferred that, separate from near-side sensor 6, means be provided which will function as safety sensor during closing of the door body 3. Furthermore, in such a case, near-side sensor 6 need not necessarily be attached to door body 3 but may instead be attached to header 22.

Furthermore, whereas near-side sensor 6 and far-side sensor 7 may be attached to door body 3 at a location which is near the top thereof and which is near the side edge at the side opposite the side supported by the foregoing pivot(s) as shown in FIG. 1, the present invention is not limited thereto, there being no limitation as to attachment location provided that attachment is made to the door body 3.

Figure 4:
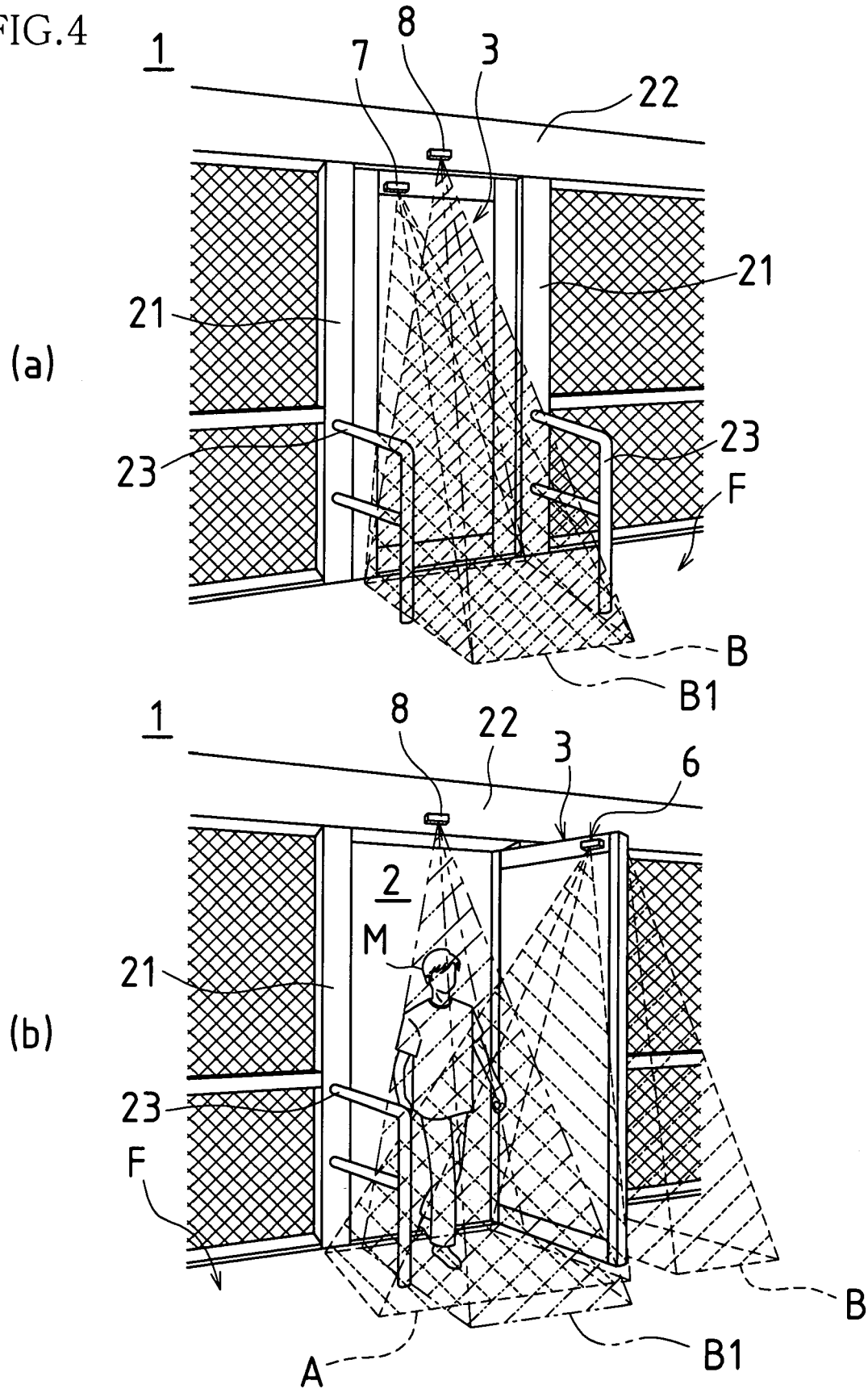
FIG. 4(*a*) is a drawing showing a closed door and FIG. 4(*b*) is a drawing showing an open door, these being oblique views of an automatic swing door associated with a variation on the first embodiment.

Furthermore, the present first embodiment only employed near-side sensor 6 and far-side sensor 7 which were attached to the door body 3 and which caused locations of respective detectable zones (zones A, B into which light is projected) to change in accompaniment to swinging of the door body 3. But this is only one embodiment. As shown in FIG. 4, as an example of another embodiment, fixed sensor 8 equipped with fixed object detecting means (not shown) which is attached to header 22 or other such fixed object and which has as detectable zone a previously established location may be employed in addition to this near-side sensor 6 and this far-side sensor 7. In such case, as shown in FIG. 4, it will be possible to cause even detectable zone(s) (zone B1 into which light is projected) which might otherwise change and be made to lie outside of region(s) intended for detection due to far-side sensor 7 to continue to be that or those intended for detection due to fixed sensor 8, making it possible to more definitively carry out detection of objects.

Figure 5:
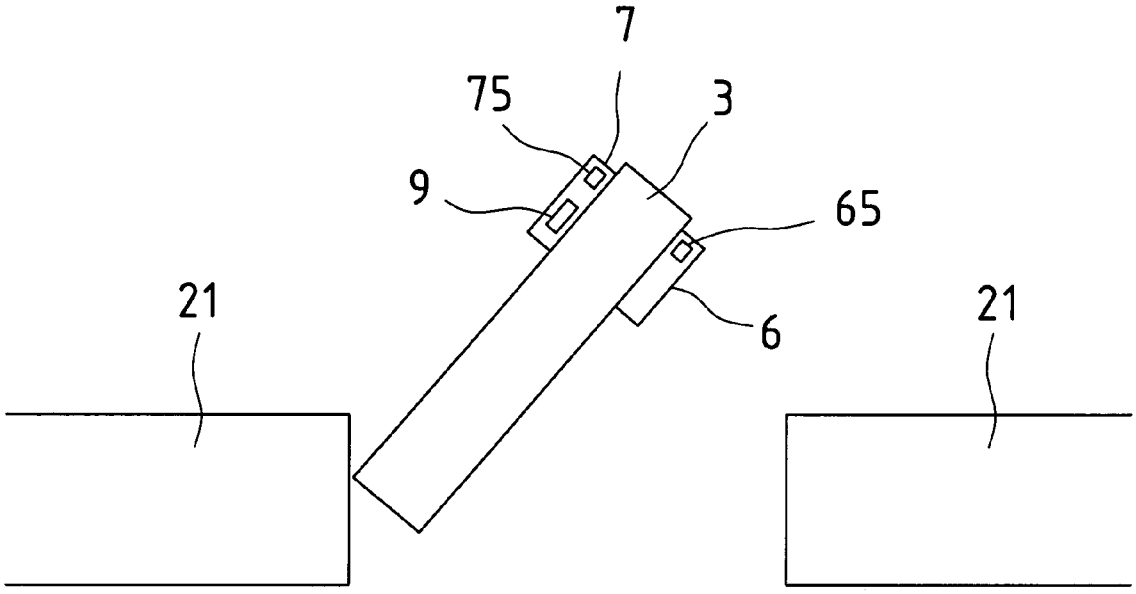
FIG. 5 is a plan view of an automatic swing door associated with a variation on the first embodiment.

Furthermore, in the present first embodiment, whereas near-side sensor 6 and far-side sensor 7 were respectively equipped with door position detecting means 67, 77 as shown in FIG. 3, the present invention is not limited thereto, it being possible to provide shared door position detecting means rather than providing near-side sensor 6 and far-side sensor 7 with respective door position detecting means. In such case, as shown in FIG. 5, such shared door position detecting means 9 may be provided at either near-side sensor(s) 6 or far-side sensor(s) 7; or alternatively, shared door position detecting means 9 may be provided at neither near-side sensor(s) 6 nor at far-side sensor(s) 7 but instead be attached as separate unit(s) to the door body or bodies 3. This is preferred because, in such a case, a corresponding door position detecting means is not provided for each respective sensor, permitting reduction in manufacturing cost and a simplified constitution. Note also that where position information output(s) from one door position detecting means are used in shared fashion with a plurality of object detection outputs from a plurality of object detecting means, the number of the door position detecting means need not be limited to one. For example, a door sensor may be constructed which employs a plurality of doors sensor units equipped with one door position detecting means for three object detecting means.

Embodiment 2

A second embodiment of the present invention will next be described. The present embodiment concerns a situation in which the present invention has been applied to an automatic revolving door.

Figure 6:
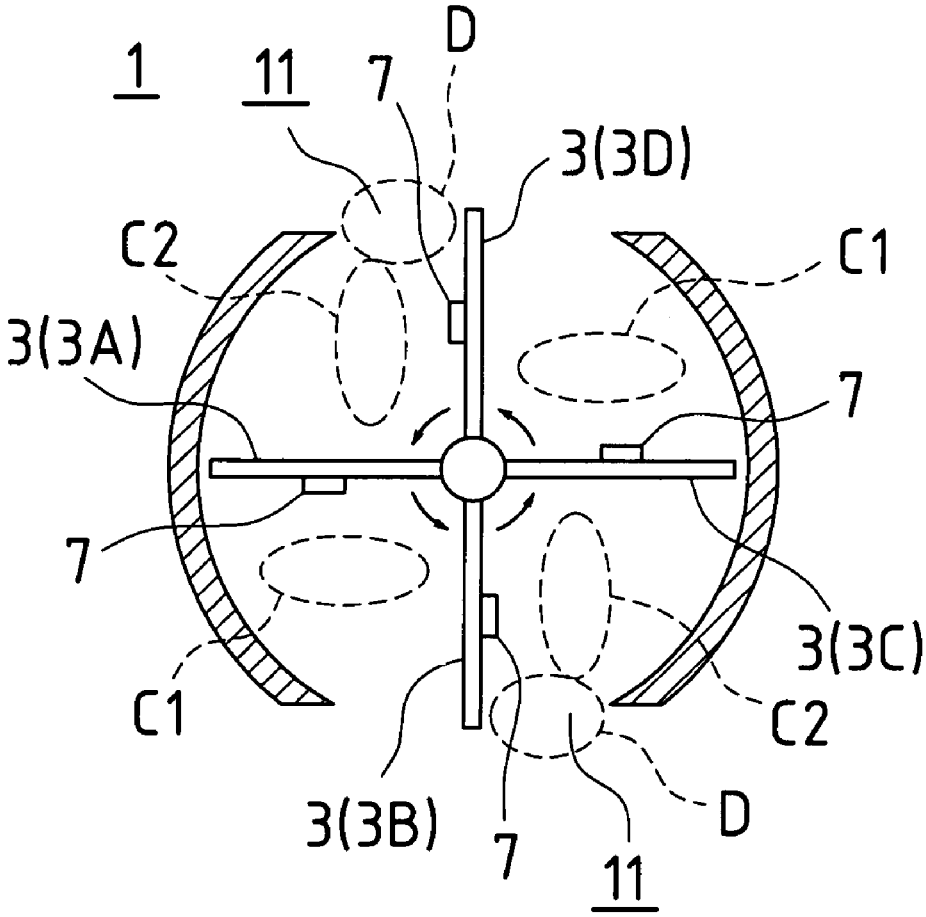
FIG. 6 is a plan view of an automatic revolving door associated with a second embodiment.
Figure 7:
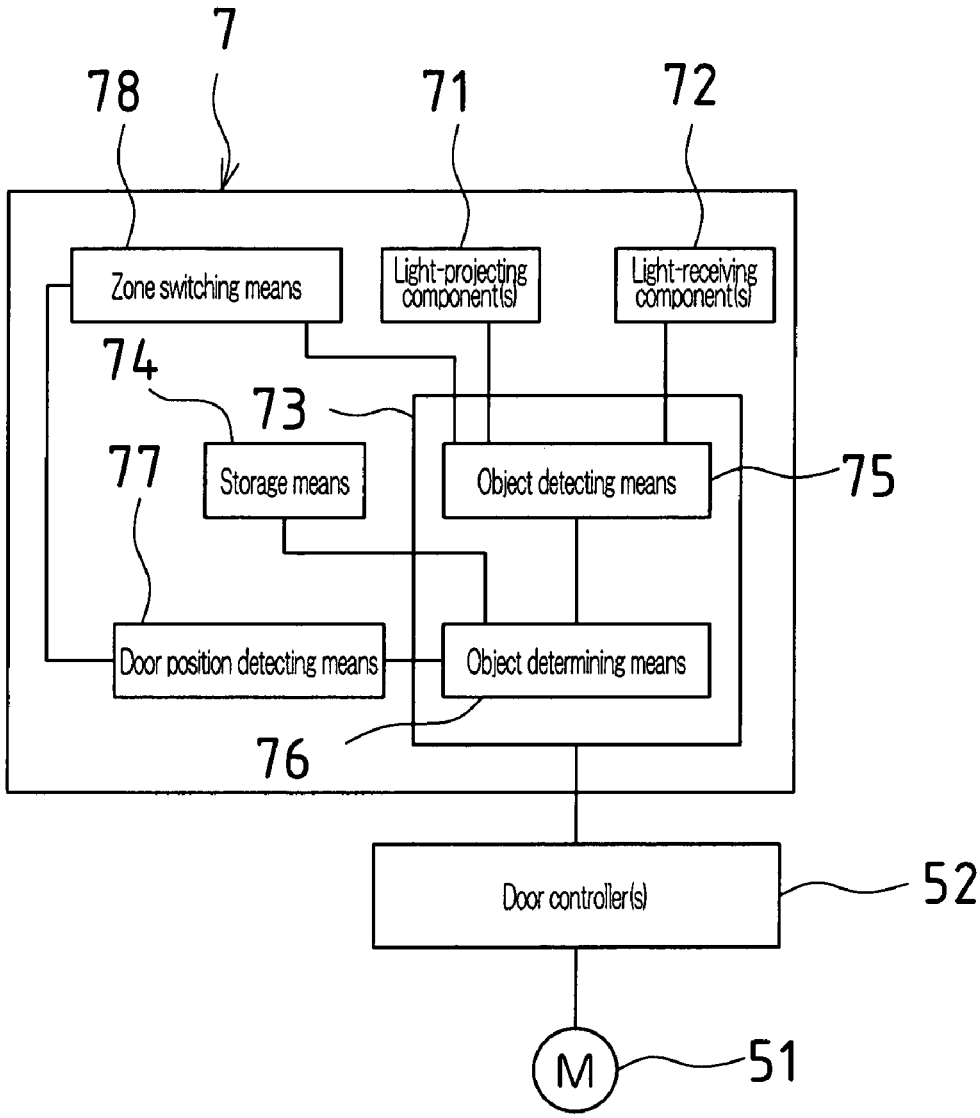
FIG. 7 is a block diagram showing a control system associated with the second embodiment.

FIG. 6 is a plan view of an automatic revolving door 1 associated with the present embodiment. FIG. 7 is a block diagram showing a control system for this automatic revolving door 1.

Automatic revolving door 1 of the present embodiment comprises four door bodies 3, 3, . . . spaced 90 degrees apart and joined together so as to rotate as a single unit. Furthermore, at the present automatic revolving door 1, a door sensor 7, more or less identical in constitution to the far-side sensor of the foregoing first embodiment, is attached to each door body 3. More specifically, these are mounted on each door body 3 in the vicinity of a location which is at the top thereof and which is more or less centrally located along the width direction thereof. Here, only the aforementioned portion different from the far-side sensor of the first embodiment will be described.

The characteristic of the door sensor 7 of the present embodiment is that it is constituted so as to permit switching of detectable zones. That is, it is constituted such that the zone into which light is projected by light-projecting component 71 can be switched. More specifically, as shown in FIG. 7, it is provided with zone switching means 78 which receives output(s) from door position detecting means 77 and which switches between or among detectable zones (zones into which light is projected by light-projecting component 71) established by object detecting means 75 in correspondence to the rotary position of the door body 3.

Below, respective detectable zones between or among which this zone switching means 78 can switch are described.

First, when in the state shown in FIG. 6, detectable zones of the door sensors 7 at door bodies 3A, 3C not positioned adjacent to portal(s) 11 are only set so as to be downstream in the direction of rotation from door bodies 3A, 3C (projected-light zone C1 indicated by broken line(s) in FIG. 6). That is, detectable zones are set so as to carry out detection only with respect to whether person(s) or other such object(s) are not present downstream in the direction of rotation from door bodies 3A, 3C.

On the other hand, detectable zones of the door sensors 7 at door bodies 3B, 3D positioned adjacent to portal(s) 11 are set so as to be downstream in the direction of rotation of the door bodies 3 and so as to be area(s) peripheral to edges(s) of opening(s) of portal(s) 11 (projected-light zones C2 and D indicated by broken line(s) in FIG. 6). That is, detectable zones are set so as to carry out detection with respect to whether person(s) or other such object(s) are not present downstream in the direction of rotation of the door bodies 3, and also so as to carry out detection with respect to whether person(s) would not be caught between edges(s) of opening(s) of portal(s) 11 and door bodies 3B, 3D if these door bodies 3B, 3D were to rotate unchecked.

Thus, in the present embodiment, rotary position(s) of respective door bodies 3A through 3D of automatic revolving door 1 are detected by door position detecting means 77 comprising geomagnetic sensors, detectable zones being switched in correspondence to such detected rotary position(s). This makes it possible to avoid situations where door sensors 7, 7 provided at door bodies 3A, 3C not positioned adjacent to portal(s) 11 detect wall surface(s) and misidentify same as object(s) intended for detection and/or situations where in spite of the fact that person(s) are present between edges(s) of opening(s) of portal(s) 11 and door bodies 3B, 3D this fact goes undetected.

Variations on Embodiment 2

The aforementioned second embodiment employed a constitution such that activation sensor(s) were not attached to the door bodies 3. That is, while not shown in the drawings, the constitution employed was such that activation sensor(s) were attached to header(s), side jamb(s), and/or the like.

Figure 8:
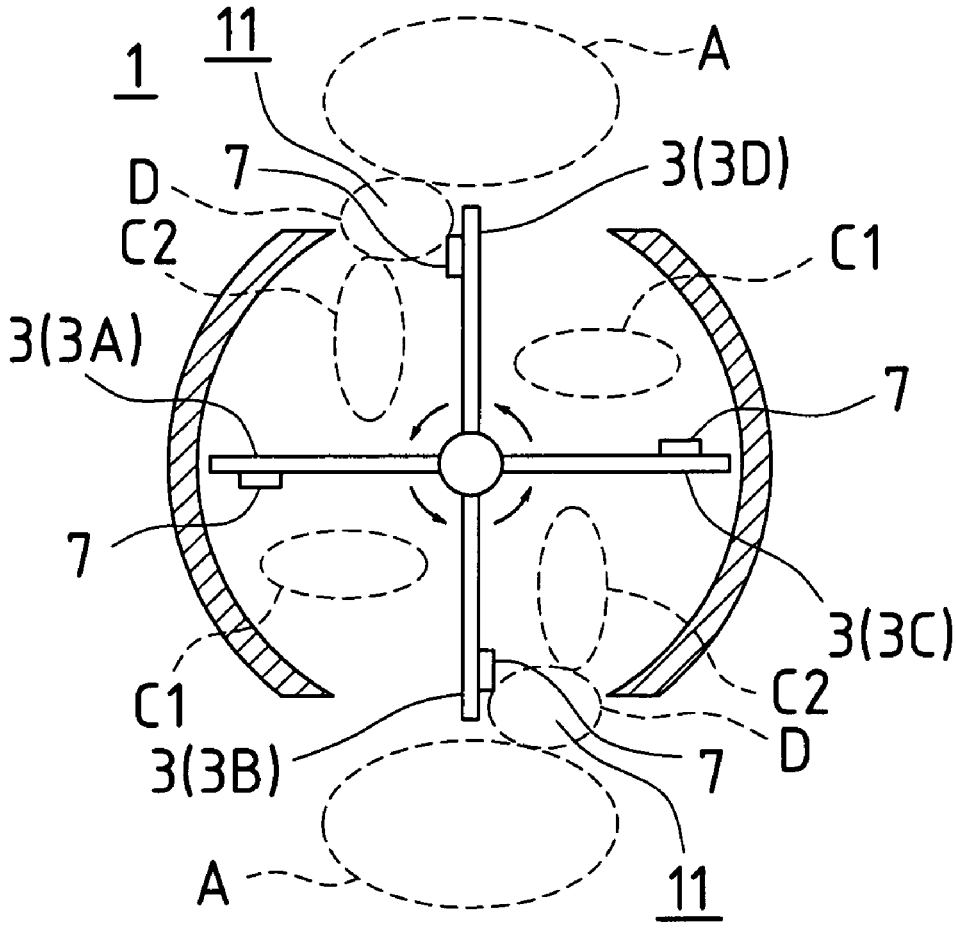
FIG. 8 is a drawing corresponding to FIG. 6 and associated with a variation on the second embodiment.

But the present invention is not limited thereto, it being possible, as shown in FIG. 8, to set detectable zones of door sensors 7 attached to respective door bodies 3 so as to be detectable zones directed toward portal(s) 11 (i.e., toward near side(s)). That is, when in the state shown in FIG. 8, detectable zones of door sensors 7 at door bodies 3A, 3C not positioned adjacent to portal(s) 11 are only set, just as was the case in the foregoing second embodiment, so as to be downstream in the direction of rotation from door bodies 3A, 3C (projected-light zone C1 indicated by broken line(s) in FIG. 8).

On the other hand, detectable zones of the door sensors 7 at door bodies 3B, 3D positioned adjacent to portal(s) 11 are set so as to be downstream in the direction of rotation from door bodies 3B, 3D, so as to be area(s) peripheral to side jamb(s) of portal(s) 11, and so as to be near-side zone(s) (projected-light zones C2, D, and A indicated by broken line(s) in FIG. 8). That is, detectable zones are set so as to carry out detection with respect to whether person(s) or other such object(s) are not present downstream in the direction of rotation from door bodies 3B, 3D, and also so as to carry out detection with respect to whether person(s) would not be caught between side jamb(s) of portal(s) 11 and door bodies 3B, 3D if door bodies 3B, 3D were to rotate unchecked, and moreover so as to carry out detection with respect to whether person(s) are not approaching from the near side.

Note that the door sensors 7 shown in FIG. 8 are mounted on each door body 3 in the vicinity of a location which is at the top thereof and which in the width direction is located in the region of the edge at the side opposite the side at which the door body 3 is joined to the other door bodies 3.

Figure 9:
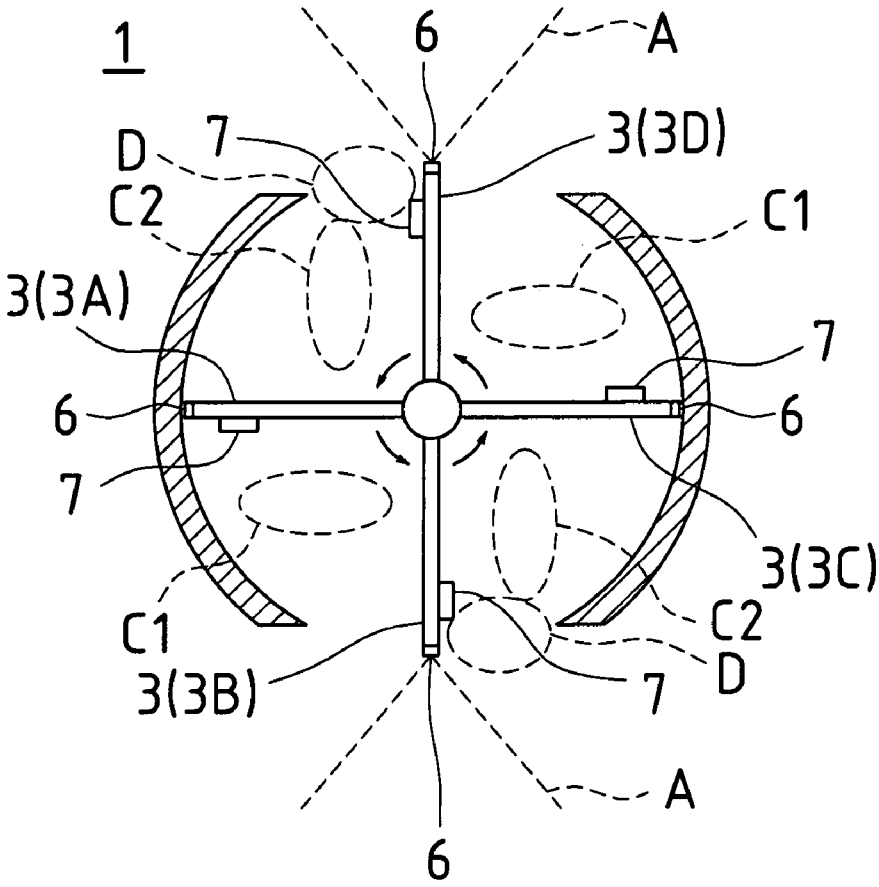
FIG. 9 is a drawing corresponding to FIG. 6 and associated with another variation on the second embodiment.

As another variation, as shown in FIG. 9, in contrast to the fact that detectable zones—and switching of detectable zones—of the door sensors 7 attached to surfaces facing toward direction(s) of rotation at respective door bodies 3A through 3D are similar to those in the foregoing second embodiment, near-side sensors 6 which project light toward the periphery may be attached to the side edges at the outer edge side of the door bodies 3A through 3D. That is, these near-side sensors 6 project light only when door bodies 3A through 3D rotate into position(s) adjacent to portal(s) 11, the constitution being such as to carry out detection with respect to whether person(s) are not approaching from the near side. This makes it possible to avoid situations where wall surface(s) are detected and are misidentified as object(s) intended for detection when door bodies 3A through 3D rotate into position(s) not adjacent to portal(s) 11.

Figure 10:
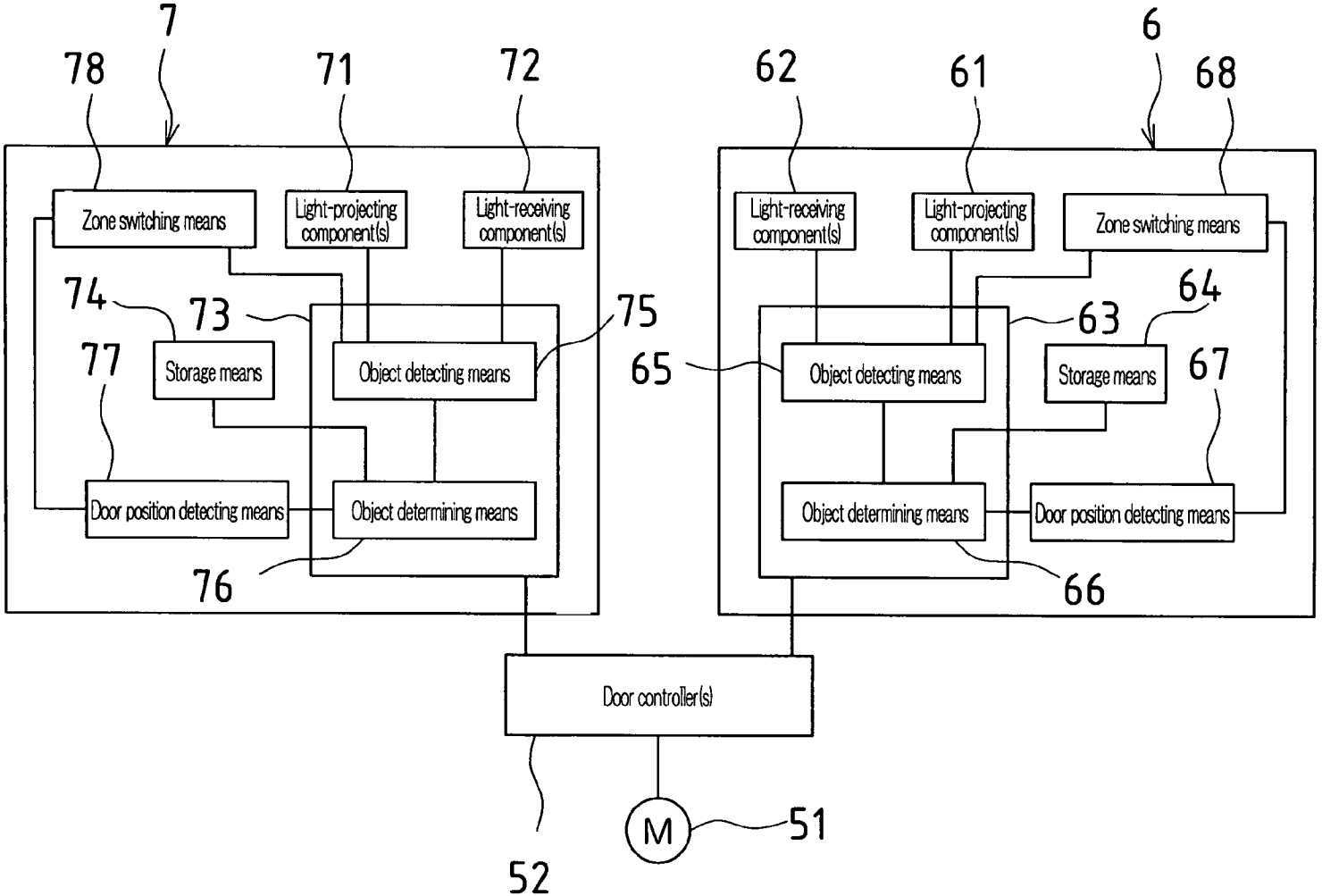
FIG. 10 is a block diagram showing a control system associated with another variation on the second embodiment.

FIG. 10 is a block diagram showing a control system for this variation. As shown in the drawing, respective sensors 6, 7 are equipped with zone switching means 78 similar to those in the foregoing second embodiment. That is, the constitution of the door sensors 7 which are attached to surfaces facing toward direction(s) of rotation at respective door bodies 3A through 3D is identical to that in the foregoing second embodiment. Furthermore, the constitution of near-side sensors 6 which project light toward the periphery and are attached to the side edges at the outer edge side of the door bodies 3A through 3D is as in the foregoing first embodiment but zone switching means 68 is or are additionally provided.

Furthermore, in the present second embodiment and in variation(s) thereon, whereas near-side sensor 6 and far-side sensor 7 were respectively equipped with door position detecting means 67, 77, the present invention is not limited thereto, it being possible to provide shared door position detecting means rather than providing near-side sensor 6 and far-side sensor 7 with respective door position detecting means. In such case, such shared door position detecting means may be provided at any of the sensors; or alternatively, may be provided at none of the sensors but instead be attached as separate unit(s) to any of the door bodies 3. Note also that where position information output(s) from one door position detecting means are used in shared fashion with a plurality of object detection outputs from a plurality of object detecting means, the number of the door position detecting means need not be limited to one. For example, a door sensor may be constructed which employs a plurality of doors sensor units equipped with one door position detecting means for three object detecting means.

Other Embodiments

Figure 11:
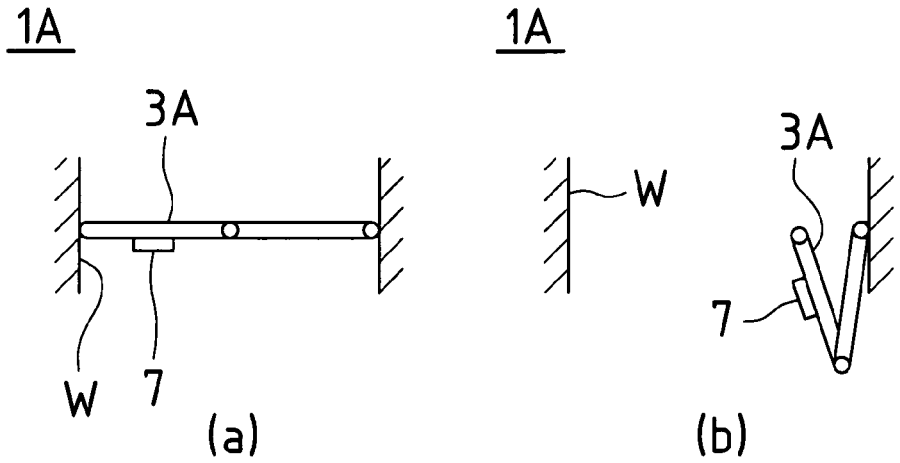
FIG. 11(*a*) is a drawing showing the closed state, and FIG. 11(*b*) is a drawing showing the open state, these being plan views of a situation where the present invention is applied to an automatic folding door.
Figure 12:
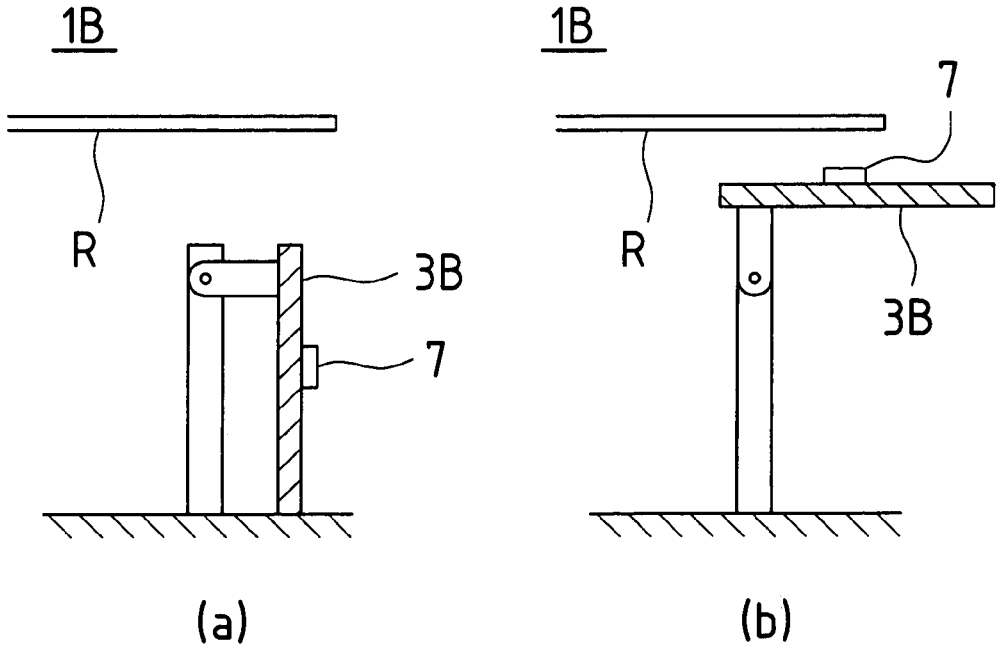
FIG. 12(*a*) is a drawing showing the closed state, and FIG. 12(*b*) is a drawing showing the open state, these being side views of a situation where the present invention is applied to an automatic upward-pivoting gate door.

In the foregoing respective embodiments and variations thereon, the present invention has been described in terms of examples in which it is applied to an automatic swing door and an automatic revolving door. But the present invention is not limited thereto, it also being possible to apply the present invention to an automatic folding door, to an automatic upward-pivoting gate door, and so forth. FIG. 11 shows how door sensor 7 associated with the present invention might be attached to an automatic folding door 1A, (a)

being the closed state and (b) being the open state. FIG. 12 shows how door sensor 7 associated with the present invention might be attached to an automatic upward-pivoting gate door 1B such as might be installed at a parking garage or the like, (a) being the closed state and (b) being the open state. As a result of adoption of such constitutions as well, it will be possible for door sensor 7 to itself detect position(s) occupied by door body 3A, 3B during opening and/or closing thereof, position(s) occupied by door body 3A, 3B during opening and/or closing thereof being identified without the need to receive door position information from door drive mechanism(s), and it will be possible for movement of door body 3A, 3B to be controlled in correspondence thereto. In the situations shown in these drawings, object(s) not intended for detection might be wall W at automatic folding door 1A, or roof R at automatic upward-pivoting gate door 1B.

Furthermore, in the foregoing respective embodiments and variations thereon, the present invention has been described in terms of examples in which it is applied to automatic doors 1. But the invention is not limited thereto, it also being possible to apply the invention to manually operated doors. For example, a constitution may be adopted such that door sensor(s) associated with the present invention are attached to the far-side face of a manually operated swing door, audible warning(s) being emitted so as to elicit caution and/or locking mechanism(s) being actuated such as will forcibly prohibit opening of the door in the event that person(s) or the like are present at the far side thereof when an attempt is made to open the door from the near side thereof. Note that in the case of a double-acting-type manually operated swing door, it is preferred that door sensors in accordance with the present invention be respectively attached to both the far-side and the near-side faces of the swing door.

As described above, in one or more embodiment(s) of the present invention, sensor(s) attached to the door body or bodies is or are itself or themselves provided with ability to detect position(s) occupied by the door body or bodies during opening and/or closing thereof, position(s) occupied by the door body or bodies during opening and/or closing thereof being identified without the need to receive door position information from external equipment, and movement of the door body or bodies is controlled in correspondence thereto. This being the case, there will no longer be a need for addition of a new ability to identify angular displacement position to the door drive mechanism(s) or other such external equipment, and moreover, there will no longer be a need for wiring installation procedures to permit output signal(s) from such external equipment to be sent to the door sensor(s). It is consequently possible to avoid making the constitution more complex and/or making installation procedures more complicated. Furthermore, with respect to automatic swing doors and other such doors which have already been installed, by simply attaching the present door sensor(s) to the door body or bodies it will be possible to control movement of the door body or bodies in correspondence to position(s) occupied by the door body or bodies during opening and/or closing thereof, and it will be possible, by retrofitting a preexisting door, to construct a door which will exhibit the foregoing effect(s), provision of a highly practical door sensor being permitted.

Moreover, the present application claims right of benefit of prior filing date of Japanese Patent Application No. 2002-199802, the content of which is incorporated herein by reference in its entirety. Furthermore, all references cited in the present specification are specifically incorporated herein by reference in their entirety.

What is claimed is:

1. A door sensor comprising:

at least one door position detector which is attached to at least one door body that can be opened and/or closed and which is capable of detecting at least one position occupied by the at least one door body during opening and/or closing thereof;

at least one object detector which is attached to the at least one door body and which detects a presence and/or an absence of at least one object in at least one detectable zone; and at least one object determining circuit which receives at least one output from the at least one door position detector and the at least one object detector, and which determines, in correspondence to at least one position occupied by the at least one door body during opening and/or closing thereof, whether at least one object detected by the at least one object detector is at least one object intended for detection, wherein the at least one door position detector is attached to at least one door body capable of being opened and/or closed as a result of rotational motion, and includes at least one sensor which employs geomagnetism to detect at least one angular displacement position of the at least one door body.

2. A door sensor according to claim 1, further comprising:

at least one door controller that is attached to at least one surface facing toward at least one direction toward which the at least one door body moves when it is being opened and that stops, slows, and/or reverses the process of opening the door body in the event that at least one object detected by the at least one object detector is at least one object intended for detection.

3. A door sensor according to claim 2, further comprising:

at least one door controller that is attached to at least one surface facing toward at least one direction toward which the at least one door body moves when it is being closed and that stops, slows, and/or reverses the process of closing the door body in the event that at least one object detected by the at least one object detector is at least one object intended for detection.

4. A door sensor according to claim 2, wherein the at least one door position detector, the at least one object detector, and the at least one object determining circuit are housed within one sensor package.

5. A door sensor according to claim 2, further comprising:

at least one fixed object detector which is attached to at least one fixed object installed at at least one arbitrary location and which detects a presence and/or an absence of at least one object within at least one detectable zone, the at least one detectable zone being at least one previously established fixed location.

6. A door sensor according to claim 2, wherein at least one position information output from one of the at least one door position detector is used in a shared fashion with a plurality of object detection outputs from a plurality of the at least one object detector.

7. A door sensor according to claim 2, wherein the at least one object detector is constituted so as to permit switching between or among detectable zones; and the door sensor further comprises at least one zone switching circuit which receives at least one output from the at least one door position detector and which switches between or among detectable zones of the at least one object detector in correspondence to at least one position occupied by the at least one door body during opening and/or closing thereof.

8. A door sensor according to claim 1, further comprising:

at least one door controller that is attached to at least one surface facing toward at least one direction toward which the at least one door body moves when it is being closed and that stops, slows, and/or reverses the process of closing the door body in the event that at least one object detected by the at least one object detector is at least one object intended for detection.

9. A door sensor according to claim 8, wherein the at least one door position detector, the at least one object detector, and the at least one object determining circuit are housed within one sensor package.

10. A door sensor according to claim 8, further comprising:

at least one fixed object detector which is attached to at least one fixed object installed at at least one arbitrary location and which detects a presence and/or an absence of at least one object within at least one detectable zone, the at least one detectable zone being at least one previously established fixed location.

11. A door sensor according to claim 8, wherein at least one position information output from one of the at least one door position detector is used in a shared fashion with a plurality of object detection outputs from a plurality of the at least one object detector.

12. A door sensor according to claim 8, wherein the at least one object detector is constituted so as to permit switching between or among detectable zones; and the door sensor further comprises at least one zone switching circuit which receives at least one output from the at least one door position detector and which switches between or among detectable zones of the at least one object detector in correspondence to at least one position occupied by the at least one door body during opening and/or closing thereof.

13. A door sensor according to claim 1, wherein the at least one door position detector, the at least one object detector, and the at least one object determining circuit are housed within one sensor package.

14. A door sensor according to claim 13, further comprising:

at least one fixed object detector which is attached to at least one fixed object installed at at least one arbitrary location and which detects a presence and/or an absence of at least one object within at least one detectable zone, the at least one detectable zone being at least one previously established fixed location.

15. A door sensor according to claim 13, wherein the at least one object detector is constituted so as to permit switching between or among detectable zones; and the door sensor further comprises at least one zone switching circuit which receives at least one output from the at least one door position detector and which switches between or among detectable zones of the at least one object detector in correspondence to at least one position occupied by the at least one door body during opening and/or closing thereof.

16. A door sensor according to claim 1, further comprising:

at least one fixed object detector which is attached to at least one fixed object installed at at least one arbitrary location and which detects a presence and/or an absence of at least one object within at least one detectable zone, the at least one detectable zone being at least one previously established fixed location.

17. A door sensor according to claim 16, wherein at least one position information output from one of the at least one door position detector is used in a shared fashion with a plurality of object detection outputs from a plurality of the at least one object detector.

18. A door sensor according to claim 16, wherein the at least one object detector is constituted so as to permit switching between or among detectable zones; and the door sensor further comprises at least one zone switching circuit which receives at least one output from the at least one door position detector and which switches between or among detectable zones of the at least one object detector in correspondence to at least one position occupied by the at least one door body during opening and/or closing thereof.

19. A door sensor according to claim 1, wherein at least one position information output from one of the at least one door position detector is used in a shared fashion with a plurality of object detection outputs from a plurality of the at least one object detector.

20. A door sensor according to claim 19, wherein the at least one object detector is constituted so as to permit switching between or among detectable zones; and the door sensor further comprises at least one zone switching circuit which receives at least one output from the at least one door position detector and which switches between or among detectable zones of the at least one object detector in correspondence to at least one position occupied by the at least one door body during opening and/or closing thereof.

21. A door sensor according to claim 1, wherein the at least one object detector is constituted so as to permit switching between or among detectable zones; and the door sensor further comprises at least one zone switching circuit which receives at least one output from the at least one door position detector and which switches between or among detectable zones of the at least one object detector in correspondence to at least one position occupied by the at least one door body during opening and/or closing thereof.

22. A door characterized in that the at least one door sensor according to claim 1 is attached to at least one door body, the door body engaging in opening and/or closing operations in linked fashion with object detecting operations of the at least one door sensor.

* * * * *